US011805369B2

(12) United States Patent
Xiao et al.

(10) Patent No.: US 11,805,369 B2
(45) Date of Patent: Oct. 31, 2023

(54) SOUNDING DEVICE

(71) Applicant: AAC Microtech (Changzhou) Co., Ltd., Changzhou (CN)

(72) Inventors: Bo Xiao, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 83 days.

(21) Appl. No.: 17/560,269

(22) Filed: Dec. 23, 2021

(65) Prior Publication Data

US 2022/0210573 A1 Jun. 30, 2022

(30) Foreign Application Priority Data

Dec. 25, 2020 (CN) ..... 202023203994.7

(51) Int. Cl.

| | |
|---|---|
| ***H04R 9/06*** | (2006.01) |
| ***H04R 9/02*** | (2006.01) |
| ***H04R 1/02*** | (2006.01) |
| ***H04R 9/04*** | (2006.01) |
| ***H04R 31/00*** | (2006.01) |

(52) U.S. Cl.

CPC ..... *H04R 9/06* (2013.01); *H04R 1/026* (2013.01); *H04R 9/025* (2013.01); *H04R 9/046* (2013.01); *H04R 31/003* (2013.01)

(58) Field of Classification Search

CPC ..... H04R 9/06; H04R 1/026; H04R 9/025; H04R 9/046; H04R 31/003; H04R 1/2834; H04R 9/043; H04R 7/04; H04R 2400/03; H05K 1/189; H05K 1/028; H05K 2201/1003

See application file for complete search history.

(56) References Cited

U.S. PATENT DOCUMENTS

2020/0413199 A1* 12/2020 Song ..... H04R 9/06

* cited by examiner

*Primary Examiner* — Walter F Briney, III
*Assistant Examiner* — Julie X Dang
(74) *Attorney, Agent, or Firm* — W&G Law Group

(57) ABSTRACT

A sounding device includes a frame, a vibration system, and a magnetic circuit system. The vibration system includes a diaphragm, a voice coil, and elastic support assemblies. The voice coil is inserted into a magnetic gap of the magnetic circuit system for driving the diaphragm to vibrate and produce sound. The elastic support assemblies are fixed to the frame and spaced apart from the diaphragm. The elastic support assemblies include elastic pieces. The elastic pieces include first fixed arms fixed to the frame, second fixed arms spaced apart from the first fixed arms and supporting the voice coil, first elastic arms connecting the first fixed arms with the second fixed arms, and second elastic arms connecting the first elastic arms with the second fixed arms. Compared with the related art, the sounding device has long service life and high reliability.

8 Claims, 4 Drawing Sheets

SOUNDING DEVICE

TECHNICAL FIELD

The present disclosure relates to the field of electro-acoustic conversion, in particular to a sounding device applied to electronic speaker products.

BACKGROUND

The sounding device is also known as a loudspeaker or a horn, which is used in a speaker to convert audio signals into sound for playback.

The sounding device in the related art comprises a frame, a vibration system fixed to the frame, and a magnetic circuit system having a magnetic gap. The magnetic circuit system drives the vibration system to vibrate and produce sound. The vibration system comprises a diaphragm, a voice coil inserted in the magnetic gap and driving the diaphragm to vibrate and produce sound, an elastic piece fixed on the frame, and a framework connecting the voice coil with the diaphragm.

However, in the sounding device in the related art, when the sounding device is working, because the number of force arms of the elastic piece is relatively small, the elastic piece is easily broken, which not only affects service life of the sounding device, but also reduces reliability of the sounding device.

Therefore, it is necessary to provide a sounding device to solve above technical problems.

SUMMARY

An object of the present disclosure is to provide a sounding device with long service life and high reliability.

In order to achieve the above object, the present disclosure provides a sounding device. The sounding device comprises a frame, a vibration system supported on the frame, and a magnetic circuit system driving the vibration system to vibrate and produce sound. The magnetic circuit system comprises a magnetic gap. The vibration system comprises a diaphragm, a voice coil, and elastic support assemblies. The voice coil is inserted into the magnetic gap for driving the diaphragm to vibrate and produce sound. The elastic support assemblies are fixed to the frame and spaced apart from the diaphragm. The elastic support assemblies comprise elastic pieces. The elastic pieces comprise first fixed arms fixed to the frame, second fixed arms spaced apart from the first fixed arms and supporting the voice coil, first elastic arms connecting the first fixed arms with the second fixed arms, and second elastic arms connecting the first elastic arms with the second fixed arms.

As an improvement, the vibration system further comprises a framework. the framework connects the diaphragm with the voice coil.

As an improvement, the voice coil is a rectangular structure with rounded corners. The framework comprises four main bodies attached to the rounded corners of the voice coil, first extending walls, and second extending walls. Each of the first extending walls is bent and extended from one side of the each of the main bodies away from the voice coil in a direction of the frame. The first extending walls are connected with the second fixed arms. Each of the second extending walls is bent and extended from one side of each of the first extending walls away from the main bodies to connect with the diaphragm. The second extending walls comprise avoiding holes penetrating through the second extending walls in a vibrating direction of the diaphragm. The voice coil, the first extending walls, and the second extending walls enclose to form an accommodating groove. The second elastic arms extend from sides of the first elastic arms close to the second extending walls and pass through the avoiding holes to connect with the second fixed arms.

As an improvement, two elastic support assemblies are provided. The two elastic support assemblies are disposed on two opposite sides of short shafts of the voice coil.

As an improvement, each of the elastic pieces comprises two second fixed arms, two first elastic arms, and two second elastic arms. The two first fixed arms of each of the elastic pieces extend to form the two first elastic arms of each of the elastic pieces. Each of the first elastic arm is extended to connect with a corresponding second fixed arm. The two first elastic arms of each of the elastic pieces extend to form the two second elastic arms of each of the elastic pieces. Each of the second elastic arm is extended to connect with a corresponding second fixed arm.

As an improvement, the diaphragm comprises a first suspension portion, a second suspension portion arranged around the first suspension portion, and a vibrating portion disposed between the first suspension portion and the second suspension portion. The first suspension portion, the second suspension portion, and the vibrating portion are ring-shaped. The second suspension portion and the first suspension portion are spaced apart. A first side of the first suspension portion away from the second ring portion is fixed to the magnetic circuit system. A first side of the second suspension portion away from the first suspension portion is fixed to the frame. A second side of the first suspension portion close to the second suspension portion and a second side of the second suspension portion close to the first suspension portion are attached to a first side of the vibrating portion away from the voice coil. The second extending walls are attached to a second side of the vibrating portion close to the voice coil.

As an improvement, the magnetic circuit system comprises a yoke fixed to the frame, a first magnet unit fixed to the yoke, and second magnet units. The second magnet units are disposed on opposite sides of long shafts of the voice coil. The second magnet units are spaced apart from the first magnet unit to from the magnetic gap. The first suspension portion is fixed to the first magnet unit, the second magnet units are accommodated in the accommodating groove. At least a portion of the first magnet unit protrudes and passes through the first suspension portion to be exposed to the diaphragm.

As an improvement, the first suspension portion comprises a first fixed portion attached to the vibrating portion, a first suspension bent and extended from a peripheral edge of the first fixed portion, a second fixed portion, and a through hole penetrating through the second fixed portion. The first suspension is bent and extended to form the second fixed portion. The second fixed portion is fixed to the first magnet unit. The portion of the first magnet unit protrudes and passes through the through hole to be exposed to an accommodating space enclosed by the diaphragm, the frame, and the yoke. The second suspension portion comprises a third fixed portion attached to the vibrating portion, a second ring, and a fourth fixed portion. The second ring is bent and extended from a peripheral edge of the third fixed portion. The second ring is bent and extended to form the fourth fixed portion. The fourth fixed portion is fixed to the frame.

As an improvement, a concave direction of the first suspension is opposite to a concave direction of the second ring.

As an improvement, the peripheral edge of the first fixed portion is bent and extended in a direction away from the magnetic circuit system to form the first ring. The peripheral edge of the third fixed portion is bent and extended in a direction close to the magnetic circuit system to form the second ring.

Compared with the related art, in the sounding device of the present disclosure, the elastic pieces comprises the first fixed arms fixed to the frame, the second fixed arms spaced apart from the first fixed arms and supporting the voice coil, the first elastic arms connecting the first fixed arms with the second fixed arms, and the second elastic arms connecting the first elastic arms with the second fixed arms. In above structures, each of the elastic pieces comprises dual force arms, which are the first elastic arms and the second elastic arms. The design of the dual force arms of the elastic pieces greatly increases flexibility of the elastic pieces, When the sounding device is working, the elastic pieces are not easily broken, thereby improving reliability of the sounding device and prolonging service life of the sounding device.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

DETAILED DESCRIPTION OF EMBODIMENTS

The following will clearly and completely describe technical solutions in the embodiments of the present disclosure in conjunction with accompanying drawings in the embodiments of the present disclosure. Obviously, the described embodiments are only a part of the embodiments of the present disclosure, not all of the embodiments of the present disclosure. Based on the embodiments of the present disclosure, all other embodiments obtained by those of ordinary skill in the art without creative work shall fall within the protection scope of the present disclosure.

Figure 1:
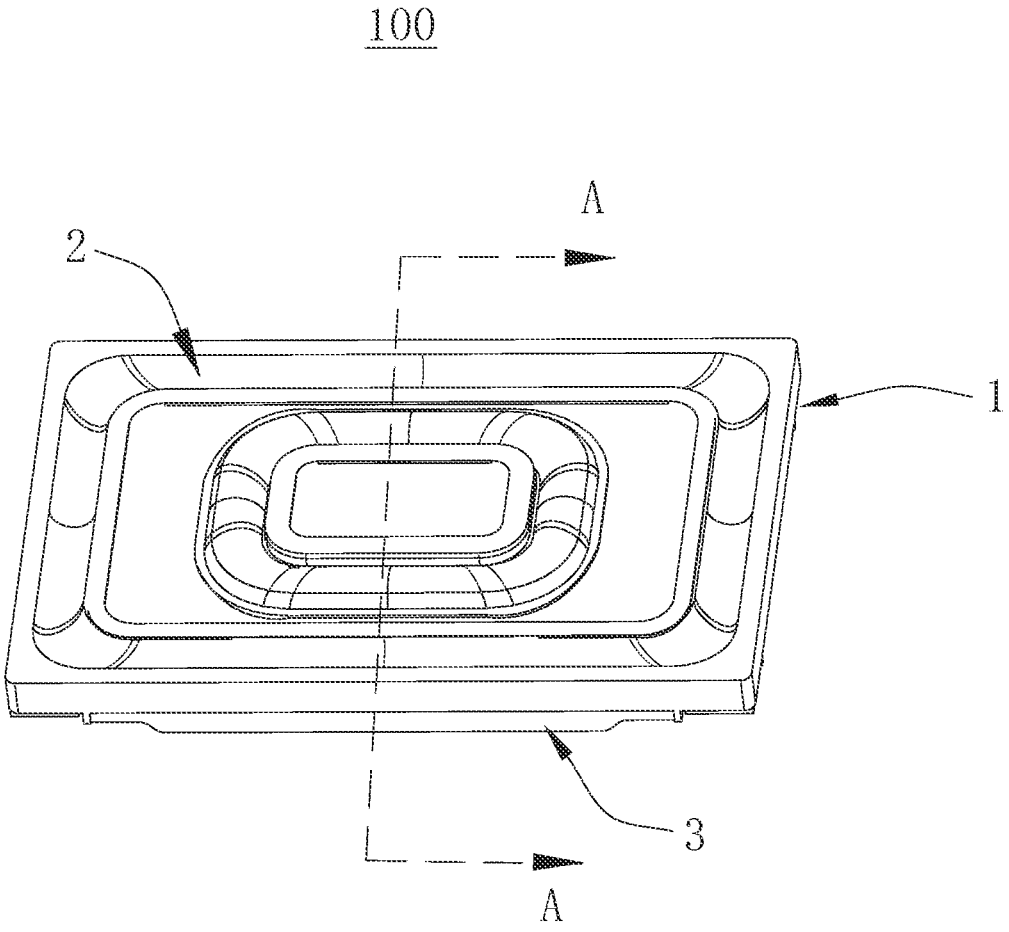
FIG. 1 is a perspective schematic diagram of a sounding device of the present disclosure.
Figure 2:
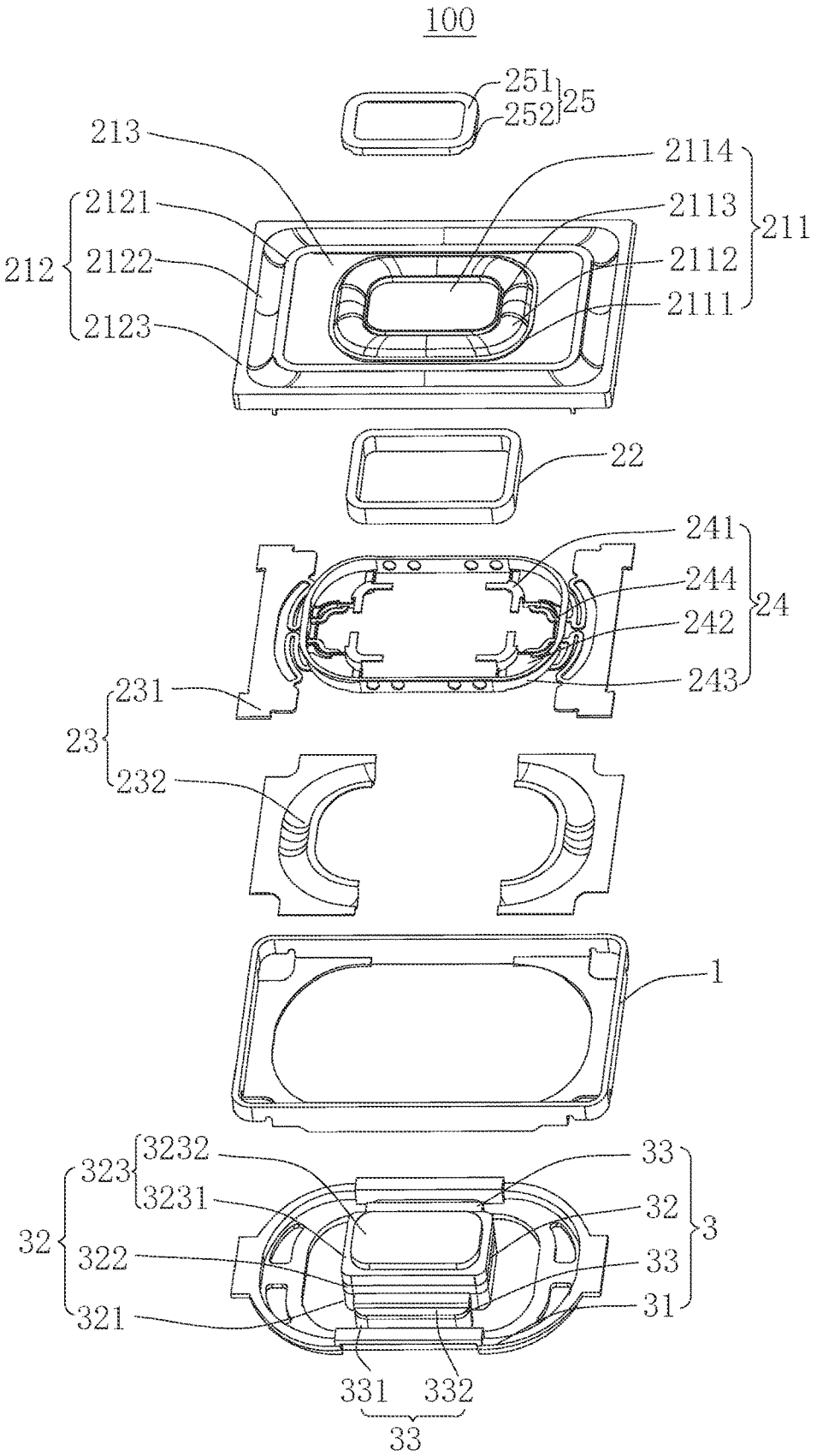
FIG. 2 is an exploded perspective schematic diagram of the sounding device of the present disclosure.
Figure 3:
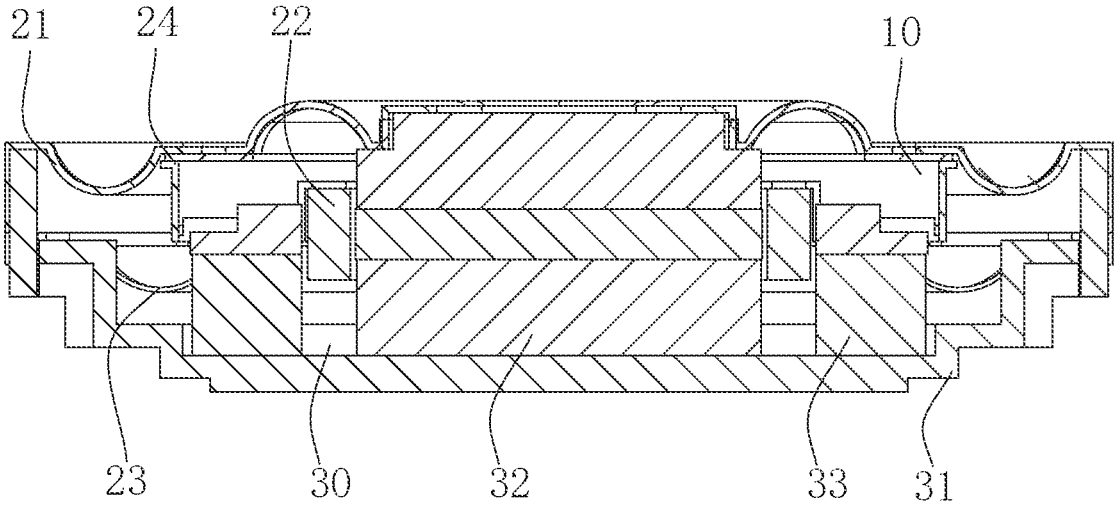
FIG. 3 is a cross-sectional schematic diagram taken along a line A-A shown in FIG. 1.
Figure 4:
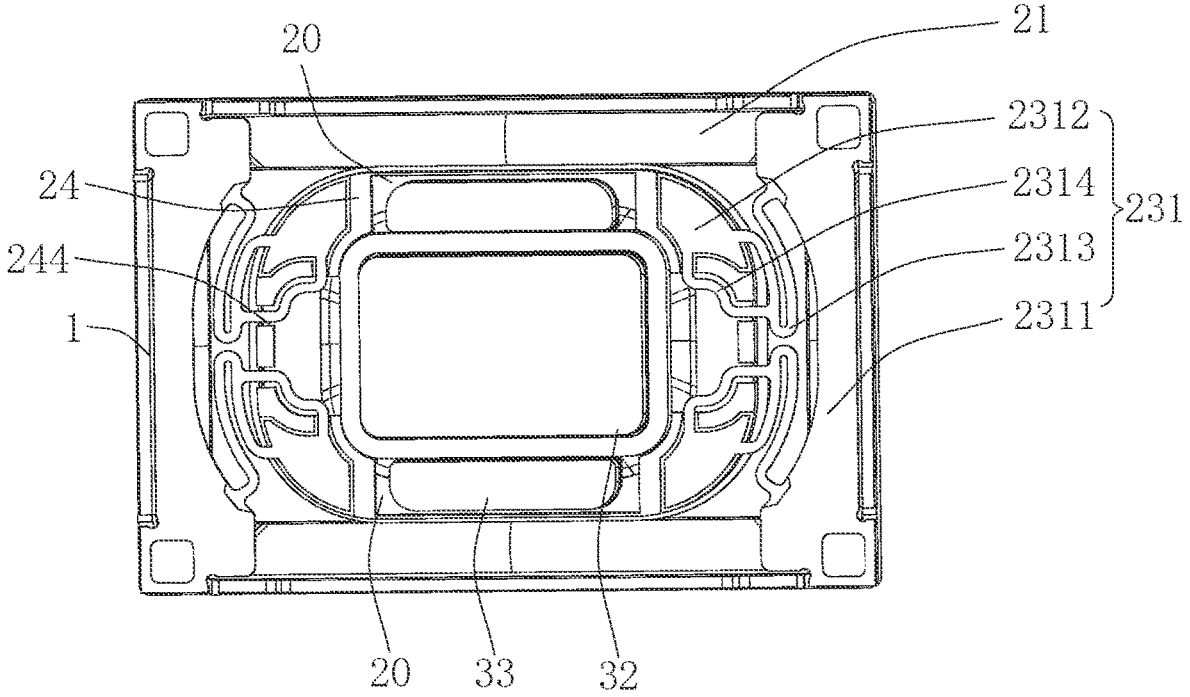
FIG. 4 is a perspective schematic diagram of portions of the sounding device of the present disclosure.

As shown in FIGS. 1-4, the present disclosure provides a sounding device 100. The sounding device 100 comprises a frame 1, a vibration system 2 supported on the frame 1, and a magnetic circuit system 3 driving the vibration system 2 to vibrate and produce sound. The magnetic circuit system 3 comprises a magnetic gap 30. The vibration system 2 comprises a diaphragm 21, a voice coil 22, elastic support assemblies 23, and a framework 24 connects the diaphragm 21 with the voice coil 22. The voice coil 22 is inserted into the magnetic gap 30 for driving the diaphragm 21 to vibrate and produce sound. The elastic support assemblies 23 are fixed to the frame 1 and spaced apart from the diaphragm 21.

Specifically, the voice coil 22 is a rectangular structure with rounded corners. Two elastic support assemblies 23 are provided. The two elastic support assemblies 23 are disposed on two opposite sides of short shafts of the voice coil 22. The elastic support assemblies 23 comprise elastic pieces 231. The elastic pieces 231 are flexible circuit boards.

In the embodiment, the elastic pieces 231 comprise first fixed arms 2311 fixed to the frame 1, second fixed arms 2312 spaced apart from the first fixed arms 2311 and supporting the voice coil 22, first elastic arms 2313 connecting the first fixed arms 2311 with the second fixed arms 2312, and second elastic arms 2314 connecting the first elastic arms 2313 with the second fixed arms 2312. In above structures, each of the elastic pieces 231 comprises dual force arms, which are the first elastic arms 2313 and the second elastic arms 2314. The design of the dual force arms of the elastic pieces 231 greatly increases flexibility of the elastic pieces. When the sounding device 100 is working, the elastic pieces 231 are not easily broken, thereby improving reliability of the sounding device and prolonging service life of the sounding device. Of course, the number of force arms of the elastic pieces is not limited thereto, which is able to be set adaptively according to actual conditions.

As an improvement, each of the elastic pieces 231 comprises two second fixed arms 2312, two first elastic arms 2313, and two second elastic arms 2314. The two first fixed arms 2311 of each of the elastic pieces 231 extend to form the two first elastic arms 2313 of each of the elastic pieces 231. Each of the first elastic arm 2313 is extended to connect with a corresponding second fixed arm 2312. The two first elastic arms 2313 of each of the elastic pieces 231 extend to form the two second elastic arms 2314 of each of the elastic pieces 231. Each of the second elastic arm 2314 is extended to connect with a corresponding second fixed arm 2312.

In the embodiment, the elastic support assemblies 23 further comprises an auxiliary diaphragm 232. The auxiliary diaphragm 232 is attached to a side of the first fixed arm 2311 away from the diaphragm 21. Arrangement of the auxiliary diaphragm 232 strengthens a horizontal rigidity of the vibration system 2 and effectively balances horizontal swing of the voice coil 2, thereby improving the stability of the sounding device.

The framework 24 comprises four main bodies 241 attached to the rounded corners of the voice coil 22, first extending walls 242, and second extending walls 243. Each of the first extending walls 242 is bent and extended from one side of each of the main bodies 241 away from the voice coil 22 in a direction of the frame 1. The first extending walls 242 are connected with the second fixed arms 2312. Each of the second extending walls 243 is bent and extended from one of each of the first extending walls 2342 away from the main bodies 241 to connect with the diaphragm 21. The second extending walls 243 comprise avoiding holes 244 penetrating through the second extending walls 243 in a vibrating direction of the diaphragm 21. The voice coil 22, the first extending walls 242, and the second extending walls 243 enclose to form an accommodating groove 20. The second elastic arms 2314 extend from sides of the first elastic arms 2313 close to the second extending walls 243 and pass through the avoiding holes 244 to connect with the second fixed arms 2312.

In the embodiment, the diaphragm 22 includes a first suspension portion 211, a second suspension portion 212 arranged around the first suspension portion 212, and a vibrating portion 213 disposed between the first suspension portion 211 and the second suspension portion 212. The first suspension portion 211, the second suspension portion 212, and the vibrating portion 213 are ring-shaped. The second suspension portion 212 and the first suspension portion 211 are spaced apart. A first side of the first suspension portion 211 away from the second ring portion 212 is fixed to the magnetic circuit system 3. A first side of the second suspension portion 212 away from the first suspension portion 211 is fixed to the frame 1. A second side of the first suspension portion 211 close to the second suspension portion 212 and a second side of the second suspension portion 212 close to the first suspension portion 211 are attached to a first side of the vibrating portion 213 away from the voice coil 22. The second extending walls 243 are attached to a second side of the vibrating portion 213 close to the voice coil 22. Arrangement of such structures enables the diaphragm 22 to have a double-ring structure, which on the one hand improves vibration effect of the diaphragm 22, and on the other hand increases adjustable factors of a frequency band, so an acoustic performance of the sounding device 100 is good.

The magnetic circuit system 3 comprises a yoke 31 fixed to the frame 1, a first magnet unit 32 fixed to the yoke 31, and second magnet units 33. The second magnet units 33 are disposed on opposite sides of long shafts of the voice coil 22. The second magnet units 33 are spaced apart from the first magnet unit 32 to from the magnetic gap 30. The first suspension portion 211 is fixed to the first magnet unit 32. The second magnet units 33 are accommodated in the accommodating groove 20. At least a portion of the first magnet unit 32 protrudes and passes through the first suspension portion 211 to be exposed to the diaphragm 21.

In the above structures, the second magnets 33 are disposed on the opposite sides of the long shafts of the voice coil 22. There is no magnet unit on the opposite sides of the short shafts of the voice coil 22. Therefore, the opposite sides of the short shafts of the voice coil 22 reserve sufficient space, so the elastic pieces are allowed to have more elastic arms to improve the flexibility and make the elastic pieces difficult to break. Moreover, the second magnet units are accommodated in the accommodating groove. The accommodating groove plays a role of positioning, which improves positioning accuracy of the second magnet units during assembly, reduces assembly errors and improves assembly efficiency.

As an improvement, the first suspension portion 211 comprises a first fixed portion 2111 attached to the vibrating portion 213, a first suspension 2112 bent and extended from a peripheral edge of the first fixed portion 2111, a second fixed portion 2113, and a through hole 2114 penetrating through the second fixed portion 2113. The first suspension 2112 is bent and extended to form the second fixed portion 2113. The second fixed portion 2113 is fixed to the first magnet unit 32. The portion of the first magnet unit 32 protrudes and passes through the through hole 2114 to be exposed to an accommodating space 10 enclosed by the diaphragm 21, the frame 1, and the yoke 31. The second suspension portion 212 comprises a third fixed portion 2121 attached to the vibrating portion 213, a second ring 2122, and a fourth fixed portion 2123. The second ring 2122 is bent and extended from a peripheral edge of the third fixed portion 2121. The second ring 2122 is bent and extended to form the fourth fixed portion 2123. The fourth fixed portion 2123 is fixed to the frame 1.

In order to further increase the vibration effect of the diaphragm and improve the acoustic performance of the sounding device 100, in the embodiment, a concave direction of the first suspension 2112 is opposite to a concave direction of the second ring 2122. Specifically, the peripheral edge of the first fixed portion 2111 is bent and extended in a direction away from the magnetic circuit system 3 to form the first suspension 2112. The peripheral edge of the third fixed portion 2121 is bent and extended in a direction close to the magnetic circuit system 3 to form the second ring 2122.

As an improvement, the first magnet unit 32 comprises a first magnet 321, a first pole core 322, and a second magnet 323. The first magnet 321, the first pole core 322, and the second magnet 323 are sequentially stacked on the yoke 31. The second magnet 323 comprises a main portion 3231 fixed on the first pole core 322 and a protruding portion 3232 protruding and extending from the main portion 3231. The protruding portion 3232 is exposed to the accommodating space 10 through the through hole 2114; The second magnet unit 33 comprises third magnets 331 fixed to the yoke 31 and second pole cores 332 covered on the third magnets 331. The third magnets 331 are spaced apart from the first magnet 321.

In the embodiment, the vibration system 2 further comprises a pressing plate 25. The pressing plate 25 comprises a flat plate portion 251 attached to one side of the protruding portion 3232 away from the first pole core 322 and an extension portion 252. The extension portion bends and extends from an outer periphery edge of the flat plate portion 251. The extension portion 252 abuts against the second fixed portion 2113. The pressing plate 25 improves an overall rigidity of the sounding device 100, thereby improving the stability of the sounding device As an improvement, in order to further increase the overall rigidity of the sounding device 100, in the embodiment, the pressing plate 25 is made of metal materials.

Compared with the related art, in the sounding device of the present disclosure, the elastic pieces comprises the first fixed arms fixed to the frame, the second fixed arms spaced apart from the first fixed arms and supporting the voice coil, the first elastic arms connecting the first fixed arms with the second fixed arms, and the second elastic arms connecting the first elastic arms with the second fixed arms. In above structures, each of the elastic pieces comprises dual force arms, which are the first elastic arms and the second elastic arms. The design of the dual force arms of the elastic pieces greatly increases flexibility of the elastic pieces, When the sounding device is working, the elastic pieces are not easily broken, thereby improving reliability of the sounding device and prolonging service life of the sounding device.

The above are only embodiments of the present disclosure. It should be pointed out that for those of ordinary skill in the art, improvements can be made without departing from the inventive concept of the present disclosure, which shall all belong to the protection scope of the present disclosure.

What is claimed is:

1. A sounding device, comprising:

a frame;

a vibration system supported on the frame; and a magnetic circuit system for driving the vibration system to vibrate and produce sound;

wherein the magnetic circuit system comprises a magnetic gap;

wherein the vibration system comprises:

a diaphragm;

a voice coil inserted into the magnetic gap for driving the diaphragm to vibrate and produce sound; and elastic support assemblies fixed to the frame and spaced apart from the diaphragm;

wherein the elastic support assemblies comprise elastic pieces;

wherein the elastic pieces comprise:

first fixed arms fixed to the frame;

second fixed arms spaced apart from the first fixed arms and supporting the voice coil;

first elastic arms connecting the first fixed arms with the second fixed arms; and second elastic arms connecting the first elastic arms with the second fixed arms;

wherein the vibration system further comprises a framework; the framework connects the diaphragm with the voice coil;

wherein the voice coil is a rectangular structure with rounded corners; the framework comprises four main bodies attached to the rounded corners of the voice coil, first extending walls, and second extending walls; each of the first extending walls is bent and extended from one side of each of the four main bodies away from the voice coil to a direction of the frame; the first extending walls are connected with the second fixed arms, each of the second extending walls is bent and extended from one side of each of the first extending walls away from the main bodies to connect with the diaphragm; the second extending walls comprise avoiding holes penetrating through the second extending walls in a vibrating direction of the diaphragm; the voice coil, the first extending walls and the second extending walls enclose to form an accommodating groove; the second elastic arms extend from sides of the first elastic arms close to the second extending walls and pass through the avoiding holes to connect with the second fixed arms.

2. The sounding device according to claim 1, wherein two elastic support assemblies are provided; the two elastic support assemblies are disposed on two opposite sides of short shafts of the voice coil.

3. The sounding device according to claim 2, wherein each of the elastic pieces comprises two second fixed arms, two first elastic arms, and two second elastic arms; the two first fixed arms of each of the elastic pieces extend to form the two first elastic arms of each of the elastic pieces; each of the first elastic arm is extended to connect with a corresponding second fixed arm; the two first elastic arms of each of the elastic pieces extend to form the two second elastic arms of each of the elastic pieces; each of the second elastic arm is extended to connect with a corresponding second fixed arm.

4. The sounding device according to claim 1, wherein the diaphragm comprises a first suspension portion, a second suspension portion arranged around the first suspension portion, and a vibrating portion disposed between the first suspension portion and the second suspension portion; the first suspension portion, the second suspension portion, and the vibrating portion are ring-shaped; the second suspension portion and the first suspension portion are spaced apart; a first side of the first suspension portion away from the second ring portion is fixed to the magnetic circuit system; a first side of the second suspension portion away from the first suspension portion is fixed to the frame; a second side of the first suspension portion close to the second suspension portion and a second side of the second suspension portion close to the first suspension portion are attached to a first side of the vibrating portion away from the voice coil; the second extending walls are attached to a second side of the vibrating portion close to the voice coil.

5. The sounding device according to claim 4, wherein the magnetic circuit system comprises a yoke fixed to the frame, a first magnet unit fixed to the yoke, and second magnet units; the second magnet units are disposed on opposite sides of long shafts of the voice coil; the second magnet units are spaced apart from the first magnet unit to from the magnetic gap; the first suspension portion is fixed to the first magnet unit, the second magnet units are accommodated in the accommodating groove; at least a portion of the first magnet unit protrudes and passes through the first suspension portion to be exposed to the diaphragm.

6. The sounding device according to claim 5, wherein the first suspension portion comprises a first fixed portion attached to the vibrating portion, a first suspension bent and extended from a peripheral edge of the first fixed portion, a second fixed portion, and a through hole penetrating through the second fixed portion; the first suspension is bent and extended to form the second fixed portion; the second fixed portion is fixed to the first magnet unit; the portion of the first magnet unit protrudes and passes through the through hole to be exposed to an accommodating space enclosed by the diaphragm, the frame, and the yoke; the second suspension portion comprises a third fixed portion attached to the vibrating portion, a second ring, and a fourth fixed portion; the second ring is bent and extended from a peripheral edge of the third fixed portion; the second ring is bent and extended to form the fourth fixed portion; the fourth fixed portion is fixed to the frame.

7. The sounding device according to claim 6, wherein a concave direction of the first suspension is opposite to a concave direction of the second ring.

8. The sounding device according to claim 7, wherein the peripheral edge of the first fixed portion is bent and extended in a direction away from the magnetic circuit system to form the first ring; the peripheral edge of the third fixed portion is bent and extended in a direction close to the magnetic circuit system to form the second ring.

* * * * *